US008529056B2

(12) United States Patent
Nakagawa et al.

(10) Patent No.: US 8,529,056 B2
(45) Date of Patent: Sep. 10, 2013

(54) PRINTING APPARATUS AND CONTROL METHOD OF PRINTING APPARATUS

(75) Inventors: Yoshinori Nakagawa, Kawasaki (JP); Osamu Iwasaki, Tokyo (JP); Atsuhiko Masuyama, Yokohama (JP); Fumiko Yano, Tokyo (JP); Satoshi Masuda, Yokohama (JP); Nobuhiro Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 355 days.

(21) Appl. No.: 12/778,504

(22) Filed: May 12, 2010

(65) Prior Publication Data

US 2010/0289841 A1 Nov. 18, 2010

(30) Foreign Application Priority Data

May 15, 2009 (JP) ..... 2009-118977
Mar. 31, 2010 (JP) ..... 2010-082797

(51) Int. Cl.
*B41J 2/01* (2006.01)

(52) U.S. Cl.
USPC ..... 347/104; 347/16; 347/21

(58) Field of Classification Search
USPC ..... 347/5, 9, 17, 21, 23, 16, 101, 104
See application file for complete search history.

(56) References Cited

U.S. PATENT DOCUMENTS

| | | | | |
|---|---|---|---|---|
| 7,395,778 | B2 | 7/2008 | Iwasaki et al. | |
| 2003/0210289 | A1 | 11/2003 | Yoshiyama et al. | |
| 2005/0178324 | A1 * | 8/2005 | Iwasaki et al. | 118/244 |
| 2005/0243121 | A1 * | 11/2005 | Onishi | 347/21 |
| 2008/0001983 | A1 | 1/2008 | Kawakami et al. | |
| 2009/0040285 | A1 * | 2/2009 | Ito | 347/104 |
| 2009/0303273 | A1 | 12/2009 | Okamoto | |

FOREIGN PATENT DOCUMENTS

| | | | |
|---|---|---|---|
| CN | 1660575 | A | 8/2005 |
| JP | 06-032925 | B2 | 5/1994 |
| JP | 06-098775 | B2 | 12/1994 |
| JP | 09-226105 | A | 9/1997 |
| JP | 11-188855 | A | 7/1999 |
| JP | 2002-316423 | A | 10/2002 |
| JP | 2004130565 | * | 4/2004 |
| JP | 2005199446 | * | 7/2005 |
| JP | 2006-051738 | A | 2/2006 |
| JP | 2006-218853 | A | 8/2006 |
| JP | 2006-218853 | A | 8/2006 |
| JP | 2006-264275 | A | 10/2006 |
| JP | 2007-090635 | A | 4/2007 |
| JP | 2007-160791 | A | 6/2007 |
| JP | 2008-044300 | A | 2/2008 |
| JP | 04114608 | B2 | 7/2008 |
| JP | 2009-101681 | A | 5/2009 |

* cited by examiner

*Primary Examiner* — Lam S Nguyen
(74) *Attorney, Agent, or Firm* — Canon U.S.A., Inc. IP Divison

(57) ABSTRACT

An apparatus includes a sheet feeding unit configured to feed sheets one by one from a storing unit, a coating unit configured to apply a coating liquid on a fed sheet, and a printing unit configured to perform printing on the coated sheet. The control unit controls timing to start a sheet feeding of a next page while a current page is being printed, depending on occurrence of event of temporary interruption or delay of printing operation.

3 Claims, 10 Drawing Sheets

PRINTING APPARATUS AND CONTROL METHOD OF PRINTING APPARATUS

BACKGROUND OF THE INVENTION

1. Field of the Invention

The present invention relates to a technology field of printing apparatuses for carrying out printing on sheets.

2. Description of the Related Art

An ink-jet printing apparatus discussed in U.S. Pat. No. 7,395,778, is provided with a coating mechanism for applying a coating liquid (pre-treatment liquid) that reacts with ink color materials, on sheets in advance before printing operation. The coating mechanism includes a coating roller having a coating surface for applying the coating liquid on a sheet, and a liquid holding member that abuts on the coating surface of the coating roller so as to form a liquid holding space in which the coating liquid is held. The coating mechanism is used to apply the coating liquid on the sheet while conveying the sheet by rotating the coating roller.

If an operation is stopped while the coating roller and the sheet are in contact with each other during the coating operation, the coating liquid spreads not only over the contacting portion of the sheet, but also over a surrounding area of the contacting portion, and as a result a large amount of the liquid is absorbed into the sheet, thereby causing an uneven coating, in which the coating liquid is not uniformly applied. If uneven coating becomes locally conspicuous, a uniform print quality on the sheet cannot be guaranteed. In an apparatus discussed in U.S. Pat. No. 7,395,778, a length of a sheet conveying path from a coating mechanism to a print start position is made sufficiently longer than a sheet length in a conveying direction so that the coating operation can be carried out without interruption. However, relatively long distance is used for the conveying path from sheet feeding to printing, accordingly relatively long time is consumed from the sheet feeding to the print start.

In order to enhance a total throughput when continuously printing a plurality of pages or sheets, a distance of the conveying path used for the sheet feeding is shortened, thereby a time (blank time of printing) consumed from completion of printing of a certain page to a start of printing of a next page is reduced as much as possible.

SUMMARY OF THE INVENTION

The apparatus according to the present invention includes a sheet feeding unit that feeds sheets one by one from a storing unit, a coating unit that applies a coating liquid on the fed sheets, a printing unit that carries out printing on the coated sheets, and a control unit that controls operations of the sheet feeding unit, the coating unit and the printing unit. The control unit controls timing to start sheet feeding of a next page, while a current page is being printed, depending on occurrence of an event of temporary interruption or delay of printing operation.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
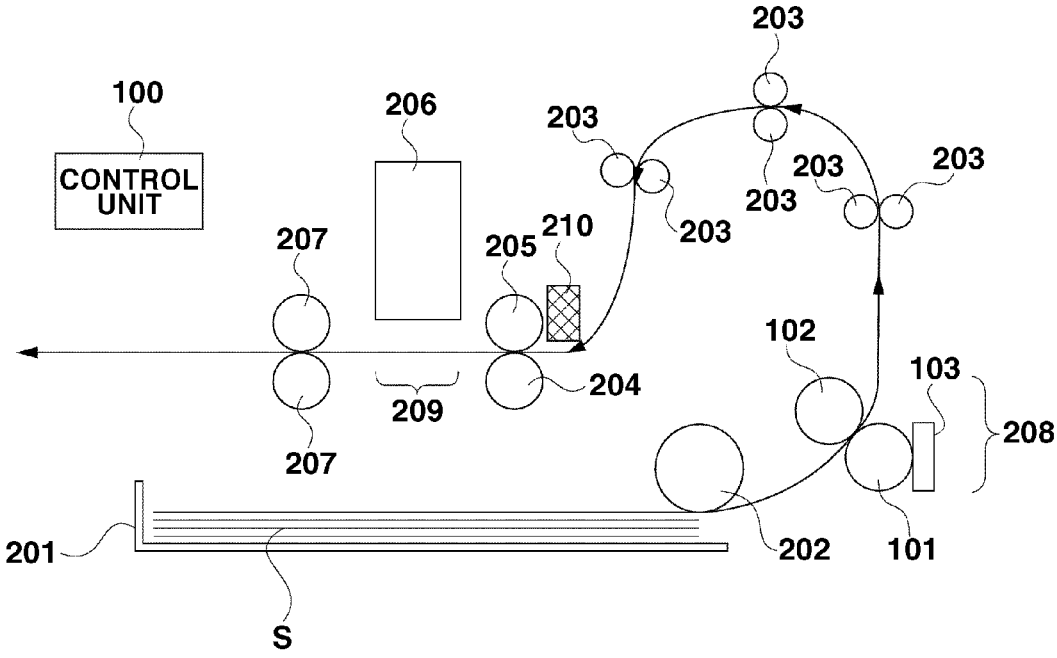
FIG. 1 is a schematic view illustrating a configuration of principal components of a printing apparatus.

FIG. 1 is a schematic view illustrating a configuration of principal components of an ink-jet printing apparatus according to a first exemplary embodiment. A sheet conveying path starting from completion of printing of a sheet fed from a cassette 201 to a discharge of the sheet is indicated by an arrow in FIG. 1. The printing apparatus includes the cassette 201 and a sheet feed roller 202 as a sheet feeding device. The cassette 201 stores in a stacking state a plurality of sheets S (a plurality of pages) serving as a recording medium. The sheet feed roller 202 is a sheet feeding unit that separates, picks up and feeds the sheets one by one page from the cassette 201. A coating mechanism 208 is a coating unit that applies a coating liquid (pre-treatment liquid) onto a sheet fed from the sheet feed roller 202. The coating mechanism 208 includes a coating roller 101, a counter roller 102, and a liquid holding member 103. A coating liquid refers to a liquid for pre-treatment that accelerates coagulation of pigments (pre-treatment liquid for pigment ink) when recording is carried out using inks composed of, for example, the pigments as color materials.

A plurality of sheet conveyance roller pairs 203 are provided along the conveying path from the coating mechanism 208 to a printing unit 209, thereby the sheets S are conveyed toward the printing unit 209. A length of the sheet conveying path from a sandwiching (holding) position between the coating roller 101 and the counter roller 102 in the coating mechanism 208 to the printing unit 209 is designed to be greater than a sheet length in a conveying direction of a maximum sheet size to be used. The design aims to prevent a sheet on which the coating liquid has been applied by the coating mechanism 208 from being printed before a trailing edge of the sheet comes out of the sandwiching position between the coating roller 101 and the counter roller 102. On the other hand, a length in the conveying path from the sheet feed roller 202 to the sandwiching position between the coating roller 101 and the counter roller 102 in the coating mechanism 208 is smaller than a sheet length of the sheet S in the conveying direction.

The conveyed sheet is sandwiched by a conveyance roller 204 and a pinch roller 205 at a position short of the printing unit 209 and is conveyed to the printing unit 209. The sheet that has reached the printing unit 209 is printed by an amount equal to a sheet width by a recording head 206, while performing sub-scan by rotational drive of the conveyance roller 204. A printing of two-dimensional image is carried out on a sheet by a combination of printing in a main scanning direction and sheet feeding in a sub-scanning direction. After completion of the printing, the sheet is discharged by a sheet discharge roller 207. A sheet sensor 210 is used to detect whether a sheet is present at a position short of the conveyance roller 204, and detect that a trailing edge of the sheet S has passed the sheet sensor 210 by grasping a change from presence to absence of the sheet. The control unit 100 includes a central processing unit (CPU), a memory, a drive circuit, and various types of input/output (I/O) interfaces, and governs operation control of the entire apparatus including sheet feeding, coating and printing. An operation unit 406 includes input circuits (e.g., buttons, keys, touch panels) and a display unit, and enables a user to input an instruction for control or the like. The display unit includes a display, and displays maintenance and printing status and various types of information about maintenance and the like.

Figure 2:
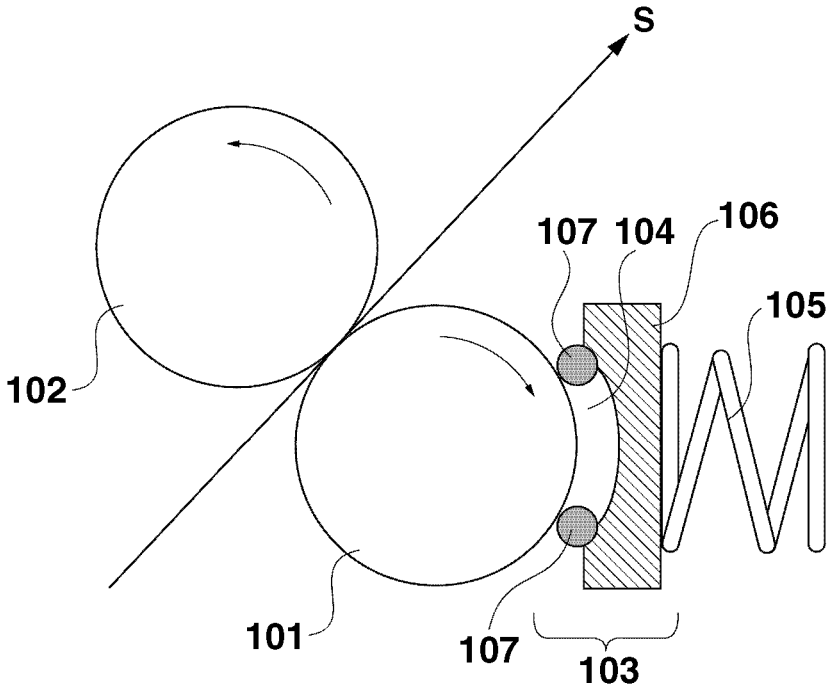
FIG. 2 is a side view illustrating a configuration of a mechanism for coating with a liquid.

FIG. 2 is a side view illustrating a configuration of the coating mechanism 208. The sheet S is sandwiched by the coating roller 101 and the counter roller 102 and is conveyed in the arrow direction in FIG. 1. A liquid holding member 103 comprises a base member 106 having a concave shape along a cylindrical surface of a coating roller 101, and a seal 107 which makes close contact therewith. A coating liquid is held in a liquid holding space 104 formed by the base member 106, the seal 107, and the coating roller 101. The liquid holding member 103 is urged by an elastic body 105 such as a spring to the coating roller 101 side, and thus a leakage of the coating liquid from liquid holding space 104 is prevented by the seal 107 making close contact with the coating roller 101. When the coating roller 101 rotates in an arrow direction in FIG. 2, the coating liquid seeps through a downstream side of a rotating direction of the liquid holding space 104, and accordingly a coating film is formed on a surface of the coating roller 101. Then, the coating liquid is transferred onto a surface of the sheet S sandwiched by the coating roller 101 and the counter roller 102.

Figure 3:
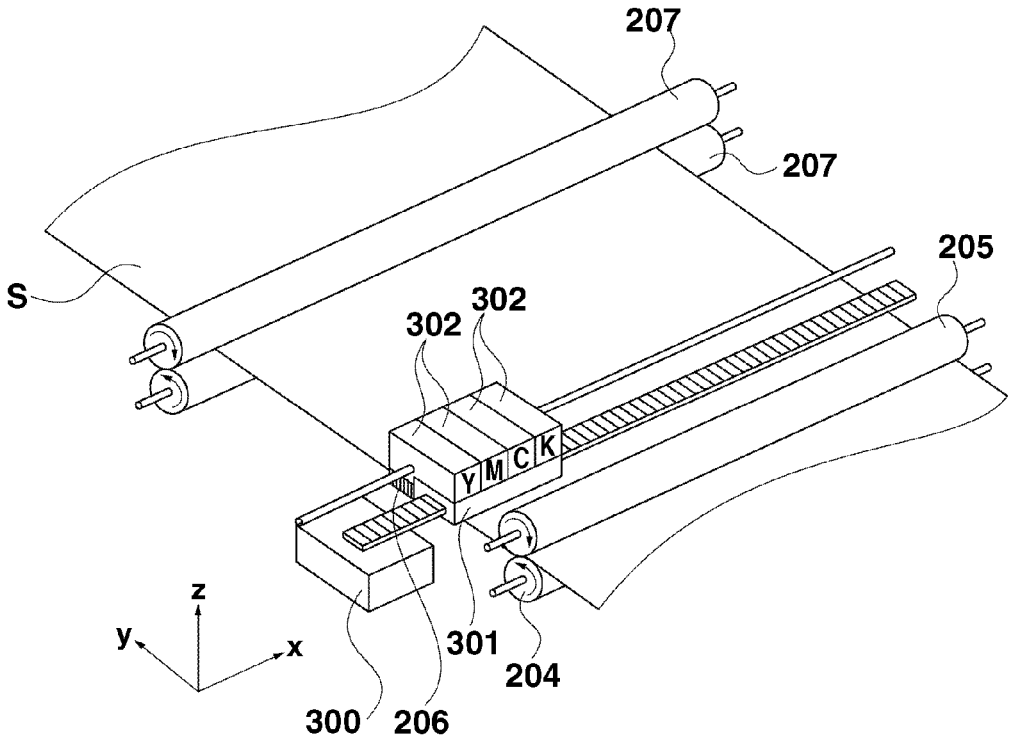
FIG. 3 is a perspective view illustrating a configuration of a printing unit.

FIG. 3 is a perspective view illustrating a configuration of the printing unit 209 and an area in the vicinity thereof. A recording head 206 is attached to a carriage 301, and inks are separately supplied to the recording head 206 from ink tanks 302 for four colors (CMYK). Each ink tank 302 is designed to be individually exchanged. The carriage 301 makes a reciprocating movement in the main scanning direction (x direction in FIG. 3) driven by a driving motor. A recovery mechanism 300 is provided within a movement range of the carriage 301 and outside a recording area. The recovery mechanism 300 is a unit for cleaning the soiled nozzle surfaces of the recording head, removing air bubbles mixed into the nozzles or clogging thereof, and receiving discharged ink when preliminary ejection is performed. A cleaning mechanism for cleaning the nozzle surfaces has a wiper, and wipes off ink adhering to the nozzle surfaces by the wiper. Further, a suction mechanism for sucking and removing air bubbles mixed into the recording head comprises a suction cap for capping the nozzle surfaces of the recording head 206 and a suction pump connected via a tube to the suction cap. The preliminary ejection is an operation to discharge ink which has been subjected to drying and shows increased viscosity within the nozzles, and a discharged ink is received by a reception unit provided in the recovery mechanism.

Figure 4:
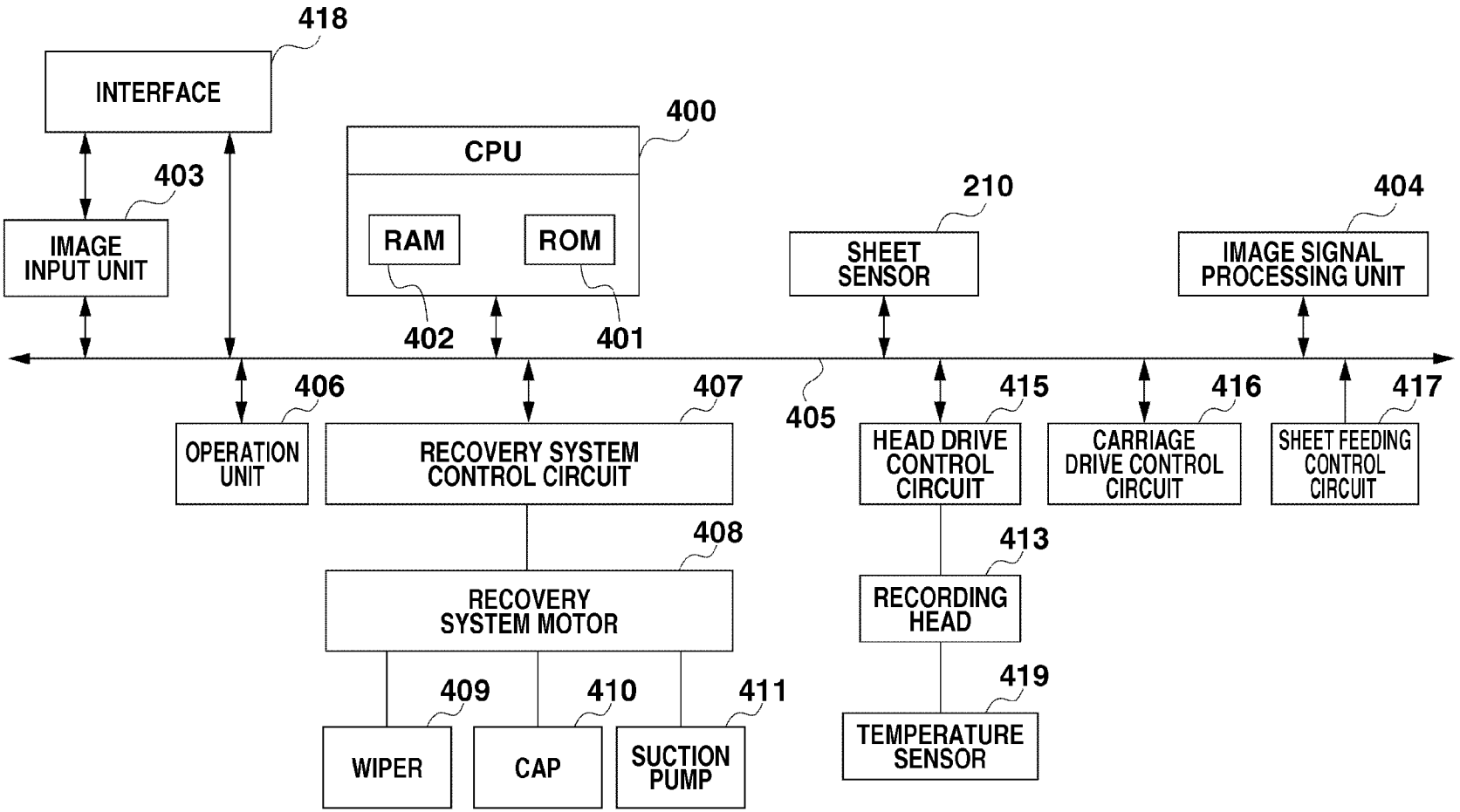
FIG. 4 is a block diagram illustrating a configuration of a control unit.

FIG. 4 is a block diagram illustrating a configuration of the control unit 100. A CPU 400 executes control and data processing of respective units of the apparatus via a main bus line 405. The CPU 400 controls data processing, recording head drive and carriage drive, according to a program stored in a read-only memory (ROM) 401, and governs print operation and various types of operations of other apparatuses. A random-access memory (RAM) 402 is used as a work area for the data processing by the CPU 400, and temporarily stores print data of a plurality of scans, remaining ink amounts in the ink tanks, and parameters or the like regarding a recovery processing of the printing apparatus. An image input unit 403 temporarily holds images input from a host apparatus via an interface 418 with the host apparatus. An image signal processing unit 404 executes data processing such as color conversion, and binarization. An input circuit and a display unit of the operation unit 406 are connected to the main bus line 405. An input from the operation unit is detected by the CPU 400, and is output and displayed on the display unit under the control of the CPU 400. A trailing edge position of a sheet can be determined from presence or absence of the sheet detected by a sheet sensor 210. In addition, absence of a sheet in a recording area can be determined from a detection of absence of a sheet by the sheet sensor 210 and a sheet feeding amount controlled by a sheet feed control circuit 417.

A recovery system control circuit 407 controls recovery operations such as a preliminary ejection, a suction operation, and wiping of a recording head nozzle surfaces, according to a recovery processing program. A recovery system motor 408 drives a recording head 413, a wiper 409 and caps 410 which are opposed to and spaced apart from the recording head 413, and a suction pump 411. A head drive control circuit 415 controls a drive for ink ejection of the recording head 413, and normally, causes the recording head 413 to perform the preliminary ejection and the ink ejection for recording operation. A carriage drive circuit 416 controls scans in the main scanning direction of the recording head 413, according to print data processed by the image signal processing unit 404. A temperature sensor 419, which is provided in the recording head 413, detects temperatures of the recording head 413.

Figure 5:
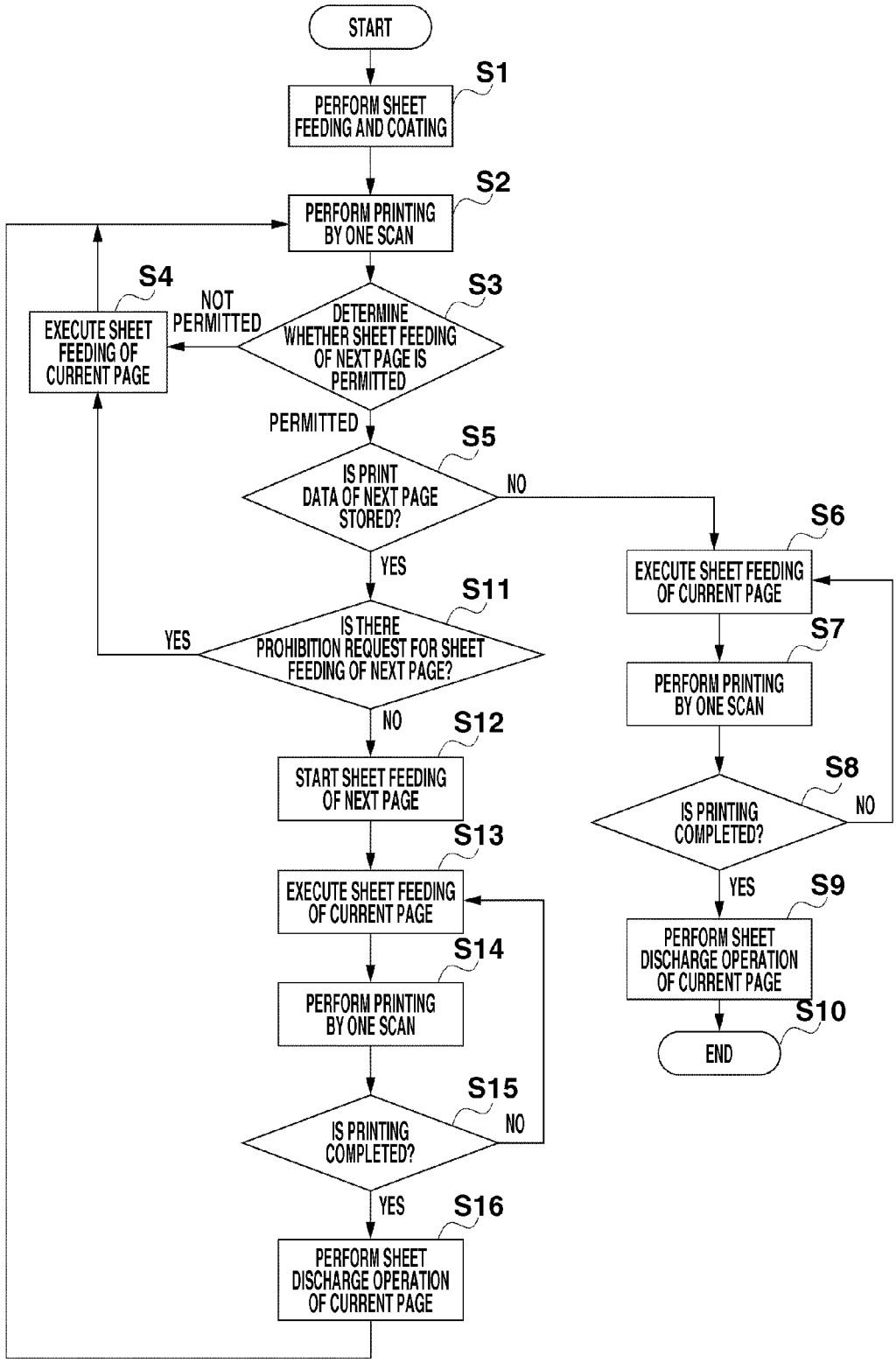
FIG. 5 is a flowchart illustrating an operation sequence of continuous printing of a plurality of pages.

Next, an operation sequence of the continuous printing of a plurality of pages will be described below with reference to a flowchart in FIG. 5. The operation sequence is performed according to an execution program stored in the control unit 100. Printing is started in accordance with a printing command from the host apparatus. In step S1, a sheet of one page (one piece) is fed by the sheet feeding unit and coating of the coating liquid is performed by the coating unit. The sheet on which coating has been performed is conveyed to the printing unit. In step S2, printing of the conveyed sheet for one band is performed by one scan (one main scan) with the recording head.

In step S3, the control unit 100 determines whether a sheet of a page to be fed next to a page currently being printed should be fed based on a sheet position as reference. The determination is made depending on whether, when the next page is fed, the sheet of the next page makes contacts with a trailing edge of the sheet of the current page. If it does not make contact, it is determined that the sheet feeding of the next page should be permitted, and if it makes contact, the sheet feeding of the next page should not be permitted. As one method, determination is made based on a sheet position of the current page. If the trailing edge of the sheet of the current page is located closer to the printing unit side than a predetermined position in the conveying path, contact of the sheets with each other can be avoided even when the feeding of the sheet of the next page is started. Another method for determination is to estimate a remaining time until printing of the sheet of the current page is completed, and to determine that the sheet feeding should be permitted if the remaining time is smaller than a predetermined value. Any of these methods may be adopted.

If the determination in step S3 is "not-permitted" (NOT PERMITTED in step S3), the processing proceeds to step S4. In step S4, a sheet feeding for one band is executed, then the processing returns to step S2 to perform printing for the next band. If the determination in step S3 is "permitted" (PERMITTED in step S3), the processing proceeds to step S5. In step S5, the control unit 100 determines whether print data of the next page is stored in a memory (RAM 402) of the control unit. If there is no print data of the next page (NO in step S5), the processing proceeds to step S6. In step S6, a sheet of the current page is subsequently fed to continue printing of the current page. Then in step S7, printing by one scan is performed. In step S8, the control unit 100 determines whether printing has been completed. If not completed (NO in step S8), the processing returns to step S6, and the sheet feeding and printing by one scan are repeated. If the printing is completed (YES in step S8), then the processing proceeds to step S9, and the sheet of the current page is discharged. Then, sequence of printing is terminated.

On the other hand, in step S5, if it is determined that there is print data of the next page (YES in step S5), the processing proceeds to step S11. In step S11, the control unit 100 determines whether a requirement for prohibition of the next page feed exists. The requirement for prohibition of the next page feed is some event of temporary interruption or delay of printing. The requirement for prohibition of the next page feed in the present example is a state where remaining amounts of inks contained in the ink tanks becomes less than a predetermined value (including empty), and exchange of the ink tanks or refilling of inks is performed. The details of the requirement for prohibition of the next page feed will be described below. If the requirement for prohibition of the next page feed exists as a result of determination in step S11 (YES in step S11), the sheet feeding of the next page is not performed. In this case, the processing proceeds to step S4, and the sheet feeding for one band is executed to continue printing of the current page. Then, the processing returns to step S2.

If the requirement for prohibition of the next page feed does not exist (NO in step S11) in the determination in step S11, the processing proceeds to step S12. In step S12, feeding operation of the next page is started in the sheet feeding unit. Then, coating of the coating liquid is performed in the coating unit, and the coated sheet is conveyed to the printing unit. In parallel with this, the sheet feeding for one band in step S13, and printing operation by one scan in step S14 are repeated on not-yet-printed area (remainder) of the current page, until it is determined that the printing has been completed in step S15. In step S16, the sheet of the current page on which printing has been completed is discharged. Subsequent to the processing in step S16, the processing returns to step S2, and the printing operation of the next page is started. Though the processing in step S12 (next sheet feeding) and the processing in step S13 through step S16 (printing of the remaining area of the current page) are executed in parallel with each other, normally, front end of the sheet of the next page never comes into contact with the sheet trailing edge of the current page. This is because, the processing in step S12 is executed only after the sheet feeding has been permitted, upon determination of a timing at which the sheet feeding of the next page is possible, in the above-described step S3 through step S11.

Figure 6:
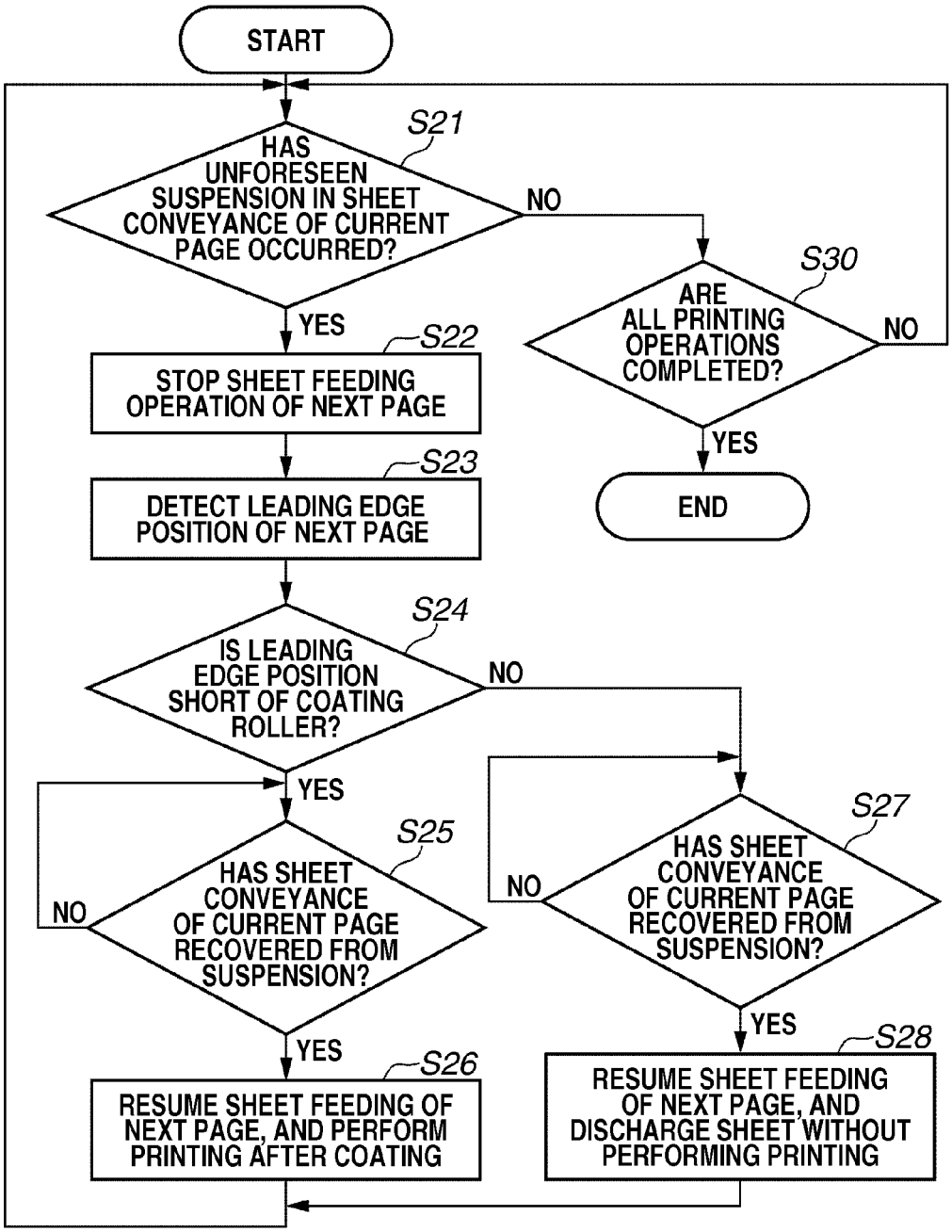
FIG. 6 is a flowchart illustrating a recovery operation sequence if a defective sheet conveyance of a current page occurs after having started sheet feeding of a next page.

In some rare cases, after the sheet feeding of the next page has been started in step S12, an unexpected interruption or delay in the sheet conveyance of the current page (in the middle of printing or sheet discharge after the printing) may occur. A defective sheet conveyance due to, for example, paper jam during the sheet conveyance may occur in some cases. Or, there may be estimation errors in the determination in step S11, and printing interruption may last long in some cases. In a case where such an unexpected printing interruption occurs, when the sheet feeding of the next page is continued, the next page might come into contact with the sheet trailing edge of the current page. Thus, after the sheet feeding of the next page is started in step S12, and after the current page is printed and the sheet discharge is started in step S16, the following recovery sequence is to be performed in parallel. FIG. 6 is a flowchart illustrating a recovery sequence, when defective sheet conveyance of the current page occurs, after the sheet feeding of the next page has been started.

In FIG. 6, in step S21, whether defective conveyance such as the unexpected interruption or delay has occurred in the sheet conveyance of the current page (in the middle of printing or sheet discharge after printing) is constantly detected by a detection unit. As an example of the detection unit, a jam sensor monitors a conveyance state of a sheet. If a defective conveyance is detected (YES in step S21), the processing proceeds to step S22. If not detected (NO in step S21), the processing proceeds to step S30. In step S30, the control unit 100 determines whether all scheduled print operations are completed. If the determination is No (NO in step S30), then the processing returns to step S21. If the determination is Yes (YES in step S30), the sequence is terminated.

In step S22, sheet feed operation of the next page by the sheet feed roller 202, which has already started, is immediately stopped. This is to prevent the next page from colliding against the trailing edge of the current page which has been stopped. Subsequently, in step S23, a leading edge position of the next page is detected by the detection unit. The detection unit estimates the leading edge position based on a rotation amount measured from a time point when the sheet feed roller 202 has started rotation, or an elapsed time. Alternatively, the leading edge position is detected by detecting presence or absence of a sheet at a plurality of locations along the sheet conveying path by sensors. In step S24, the control unit 100 determines whether the detected leading edge position is a position short of a coating position of the coating mechanism 208 (a sandwiching position between the coating roller 101 and the counter roller 102). If the determination is Yes (YES in step S24), then the processing proceeds to step S25. If the determination is No (NO in step S24), then the processing proceeds to step S27.

If the sheet is stopped before the leading edge of the next page reaches the coating position of the coating mechanism 208, it is possible to prevent the coating liquid from adhering to the sheet, and as a result, the sheet can be handled as a normal product. If the determination is Yes in step S24, then in step S25 the processing awaits until the sheet conveyance of the current page (in the middle of printing or sheet discharge after printing) recovers from suspension. If it has recovered (YES in step S25), the processing proceeds to step S26. In step S26, the sheet feeding of the next page is resumed, and the coating operation is resumed by the coating mechanism 208. Since the coated sheet is a normal product which is free from the uneven coating, printing is performed by the recording head 206 of the printing unit 209. Then, the processing returns to step S21, and the similar processing is repeated.

On the other hand, if the determination in step S24 is No (NO in step S24), the coating liquid has been already applied onto a portion of the sheet of the next page, and the sheet feeding is stopped halfway through the coating operation. As a situation peculiar to the coating operation, if the sheet is not caused to pass the coating mechanism 208 at a uniform velocity, uneven applying of the coating liquid onto the sheet occurs. Consequently, if a sheet is stopped at a position halfway through the coating operation, much more coating liquid than usual is applied onto the area, and as a result, uneven coating locally occurs. As a recovery work from paper jam, for example, takes time and a stopping time becomes longer, the uneven coating becomes more conspicuous, and accordingly for the sheet, consistent print quality can no longer be guaranteed.

In step S27, the processing waits until the sheet conveyance of the current page (in the middle of printing or sheet discharge after printing) recovers from suspension. If it has recovered from suspension (YES in step S27), the processing proceeds to step S28. In step S28, the sheet feeding of the next page is resumed and the remaining coating is performed. However, since the sheet is not suited to a high-quality printing, the sheet is discharged from the apparatus without printing by the printing unit 209. The discharged sheet is discarded by a user as a defective product. Then, further sheet feeding of the next page is started. The processing returns to step S21, and similar processing is repeated. In a case where the paper jam occurs also at the sheet feeding unit side, and sheet discharge cannot be automatically performed, the apparatus may instruct the user to execute maintenance, and the user may remove the sheet from the path and discharge it.

As described above, if an occurrence of the unexpected interruption is detected during the sheet conveyance of the current page after the sheet feeding of the next page has been started, the sheet feeding of the next page is immediately stopped. Then, it is determined whether to perform printing on a sheet to be fed after having resumed the sheet feeding, or to discharge the sheet without performing printing, depending on the leading edge position of the next page, which has ceased to be fed. The control is executed such that, if the leading edge position of the next page is located short of a coating position by the coating unit, printing is performed after resuming the sheet feeding, and if the leading edge position of the next page has passed the coating position of the coating unit, printing is not performed after having resumed the sheet feeding. Accordingly, even in the event that unexpected error should occur after the sheet feeding of the next page has been started, and a conveyance of the preceding current page is stopped, appropriate measures can be taken. Since a sheet, which has resulted in a defective coating is discharged as a defective product only when the next page could not be saved, consumption of sheets and coating liquids due to failures can be reduced.

Figure 7:
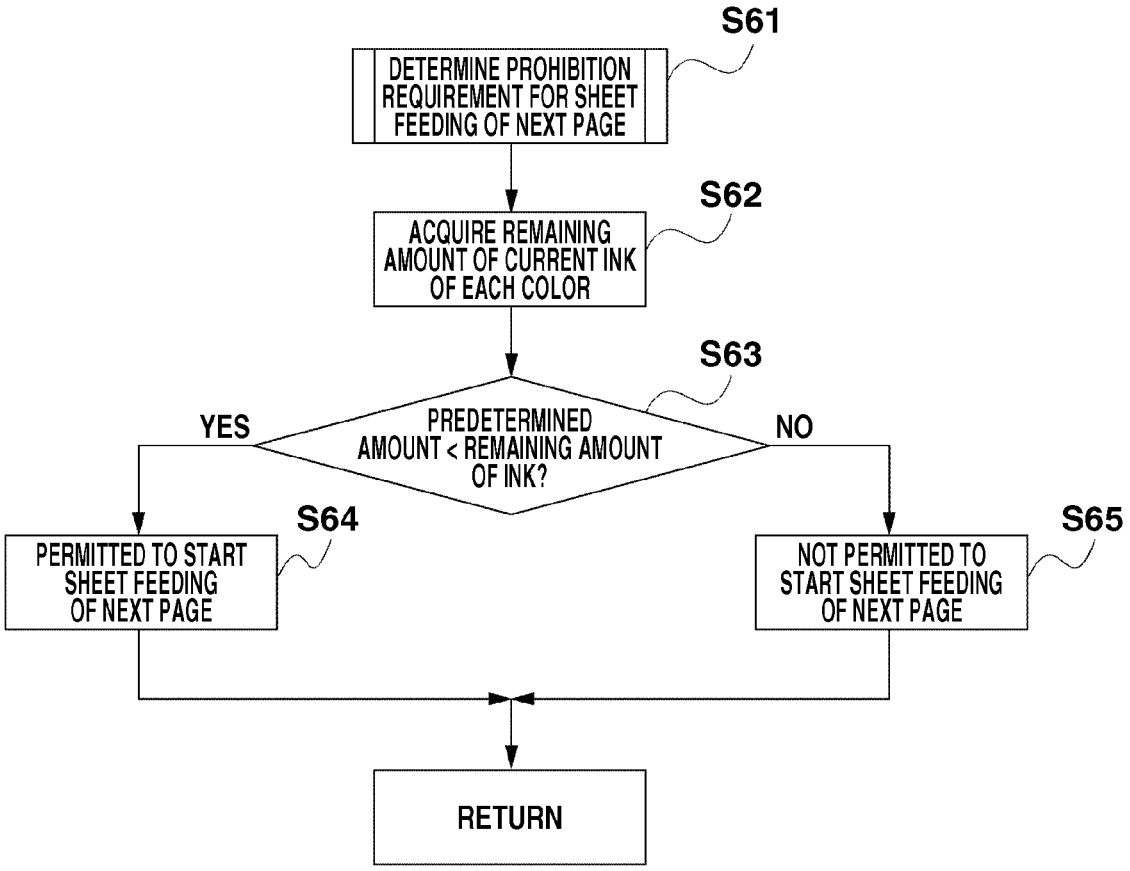
FIG. 7 is a flowchart illustrating a determination sequence according to a first exemplary embodiment.

Hereinbelow, a requirement for prohibition of the next page feed in step S11 will be described in greater detail while referring to the flowchart in FIG. 7. In step S61, a determination process about the requirement for prohibition of the next page feed is started. In step S62, remaining amounts of ink tanks for respective CMYK colors at the present time point are acquired. The remaining ink amounts within the ink tanks, that is, liquid level heights of the inks within the ink tanks can be detected by optical, electrical sensors or a sensor using another physical technique. As an alternative technique, a remaining amount can be obtained by estimating consumed ink amount from print data for already printed portion, without using sensors, and by subtracting a cumulative consumed amount from a capacity of a new ink tank.

In step S63, it is determined whether a remaining ink amount is larger (YES in step S63) or smaller (NO in step S63) than a predetermined value for respective colors. A predetermined value, which is herein used, refers to a total of an ink amount is to be consumed for printing the remaining area of the current page, and an ink amount is to be consumed for printing the next page (whole one page), that is, a total value of two parameters. If Yes (YES in step S63), a remaining ink amount does not run out while the next page is being printed, and therefore a start of the sheet feeding of the next page should be permitted in step S64. On the other hand, if No (NO in step S63), there is a possibility that the color ink may run out halfway through in printing of the next page (halfway through in printing of the current page in the worst case), and therefore a start of the sheet feeding of the next page should not be permitted in step S65. If it is not permitted, the sheet feeding of the next page is not performed, and the user is prompted to exchange color ink tank which is lacking in the remaining amount, at a stage where the printing of the current page is terminated.

The predetermined value may be a fixed value derived from experiences, but for the purpose of more accurate determination, the above-described two parameters that constitute the predetermined value are to be estimated as accurately as possible, and make the predetermined value variable depending on situations. An ink usage amount is to be consumed for the remaining print of the current page can be calculated based on print data of the current page, which is not yet printed. A printed image is composed of aggregate of a large number of ink dots that has reflected the print data, and an integral value of ink amounts of respective dots gives a total of ink usage amounts. Similarly, an ink amount is to be consumed for printing of the next page can be calculated from the print data of the next page. If an ink amount is to be consumed for the printing of the next page is determined from the print data of the next page, more accurate value can be obtained. However, calculation may be simplified by using a fixed value empirically obtained (for example, ink amount which enables solid setting of one-half page).

As described above, it is determined whether there remains ink in an enough amount, on the basis of a predetermined value set according to a remaining ink amount and ink usage amount estimated by an analysis of not-yet-printed data, and control is performed to determine whether the sheet feeding of the next page by the sheet feeding unit while the current page is being printed should be permitted. The sheet feeding of the next page is started and coating is performed while the current page is being printed, so that a throughput in carrying out continuous printing can be enhanced. At that time, the control unit controls timing at which the sheet feeding of the next page is started, depending on a situation of an event of temporary interruption or delay of printing operation. Consequently, the current page and the next page are prevented from colliding against each other, and a sheet conveying velocity during coating operation can be kept constant, and as a result, uneven coating of the coating liquid never occurs. Further, a conveyance is not stopped along the way from the coating unit to the printing unit, and the sheets are not left for long time. Accordingly, a sheet on which the coating liquid is applied, is prevented from strongly curling, or the coating liquid is prevented from being transferred unevenly from the sheet toward a guide of the conveying path.

A second exemplary embodiment of the present invention will be described below. Since an operation sequence of printing is similar to that illustrated in FIG. 5, descriptions thereof will not be repeated. Difference from the foregoing exemplary embodiment is the determination in step S11 in FIG. 5.

If the recording head is continuously driven at a high load (high print duty) for a long time, heat generation by an energy generating source of the recording head cannot be dealt with by cooling and thus temperature in the recording head may increase. This is particularly noticeable in a thermal type ink-jet recording head, in which a heater (heat generating element) is used for energy generating source. Since driving of the actuator generates heat not only in the thermal type, but also in an ink-jet recording head using an actuator such as a piezoelectric elements or micro-electro-mechanical (MEMS) as the energy generating element, the similar situations may occur. Thus, performing control not to exceed a predetermined temperature (head failure temperature) at which the recording head may possibly be damaged due to temperature rise is to be carried out. In the present example, temperature of the recording head is detected by providing a temperature sensor in the vicinity of the recording head, and a printing operation is temporarily interrupted before the head reaches breakdown temperature. Then, the printing operation is resumed after waiting until temperature of the recording head drops. Therefore, a temporary print interruption time (waiting time) may be taken during the printing operation. If a print interruption occurs during the coating operation after feeding the sheet of the next page, a conveyance of the sheet is interrupted, and accordingly the coating operation is also interrupted, and it might cause an uneven coating on the sheet. Thus, in the present example, a waiting time to be taken for cooling of the recording head during printing operation, is defined as a temporary print interruption event. This event is defined as the requirement for prohibition of the next page feed in step S11 in FIG. 5.

Figure 8:
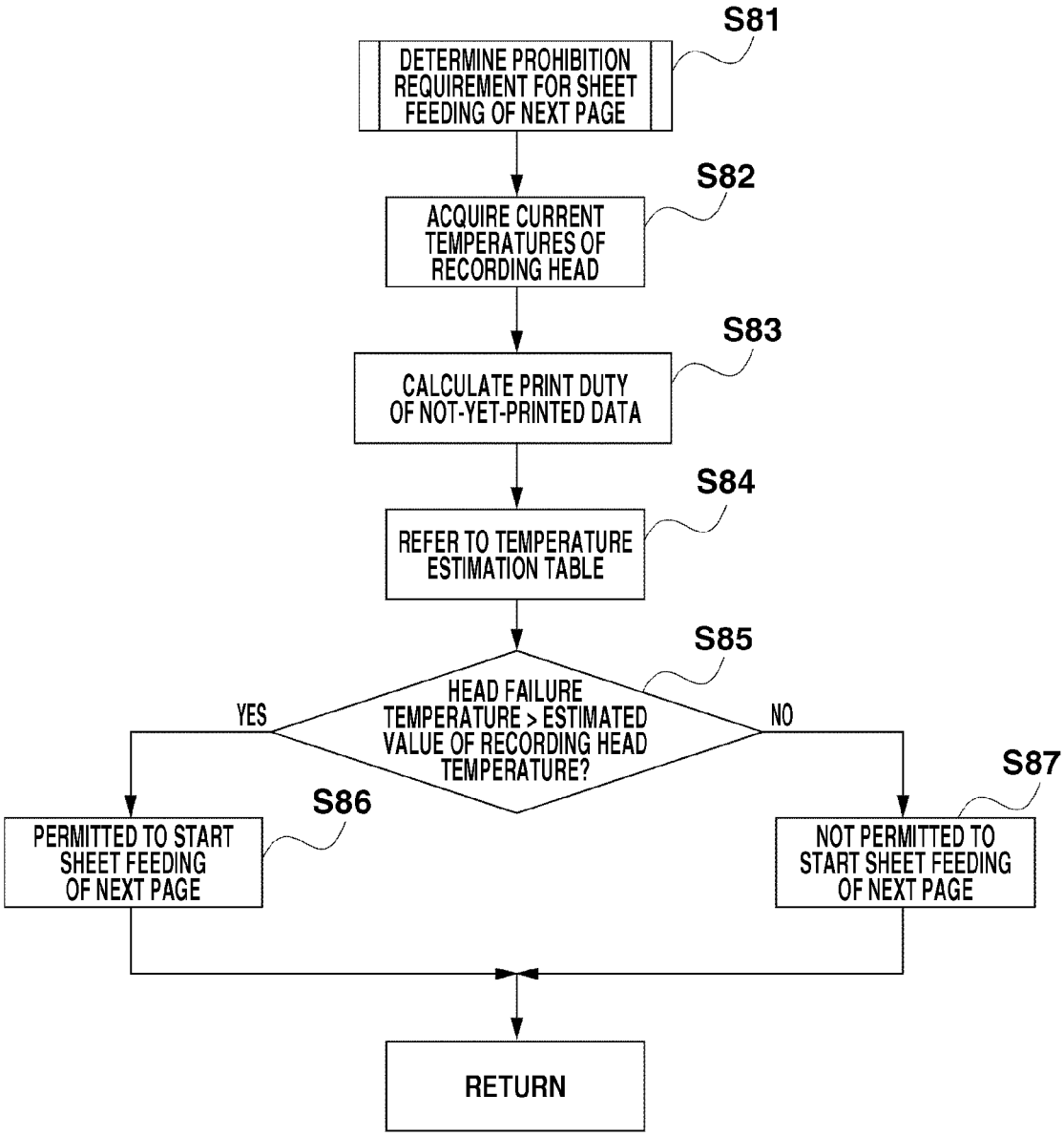
FIG. 8 is a flowchart illustrating a determination sequence according to a second exemplary embodiment.

An operation sequence when a waiting time to be taken for cooling of the recording head is defined as a requirement for prohibition of the next page feed will be described below with reference to a flowchart FIG. 8. In step S81, the control unit starts a determination process about the requirement for prohibition of the next page feed. In step S82, the control unit acquires current information about temperatures of the recording head from an output detected by a temperature sensor. In step S83, the control unit analyzes not-yet-printed data stored on a memory (RAM 402) of the control unit, and calculates a print duty from a number of ink dots and a print area.

In step S84, the control unit determines a maximum temperature of the recording head (estimated value of recording head temperature) that would be reached during a printing operation of the current page from the current recording head temperature and the print duty of the not-yet-printed data, using a temperature estimation table obtained from experiences and stored in advance in the memory. In step S85, the control unit compares between the determined estimated value of the recording head temperature and the foregoing predetermined temperature (head breakdown temperature). If the head breakdown temperature is higher than the estimated value of the recording head temperature (YES in step S85), it is determined that the waiting time will not be taken by cooling during the printing operation of the current page. In step S86, a start of the sheet feeding of the next page should be permitted.

On the other hand, if the head breakdown temperature is not higher than the estimated value of the recording head temperature (NO in step S85), it is determined that it is possible that a waiting time is taken in cooling during printing of the current page. In step S87, a start of sheet feeding of the next page is not permitted.

As described above, the control unit estimates that temporary interruption of printing occurs for cooling purpose, based on the output detected by the temperature sensor and the not-yet-printed data. Further, the control unit performs control to determine whether the sheet feeding of the next page by the sheet feeding unit while the current page is being printed should be permitted based on the estimation. More specifically, the control unit analyzes the print duty of the not-yet-printed data, and estimates a maximum temperature during printing of the current page from the output detected by the temperature sensor and the print duty. Then, if the estimated temperature is higher than the predetermined temperature, the control unit performs control such that the sheet feeding of the next page by the sheet feeding unit while the current page is being printed should not be permitted. Similar effect to that described in the first exemplary embodiment can be obtained as well in the second exemplary embodiment.

The present invention is not limited to ink-jet printing apparatuses. The present invention can be also applied to other types of a printing apparatus (e.g., sublimation type printing apparatus and thermal transfer printing apparatus) provided with a thermal type recording head other than an ink-jet.

A third exemplary embodiment of the present invention will be described below. Since an operation sequence of printing is similar to that in FIG. 5, description thereof is not repeated. A difference from the foregoing exemplary embodiment is the determination in step S11 in FIG. 5.

A power consumption increases as a number of simultaneous ink ejections from the recording head increase, and accordingly expansion of power source capacity leads to an increase in cost of the printing apparatus. Simultaneous ink ejections from all nozzles do not frequently occur in the printing of a normal image. Thus, the control unit performs control to limit a number of the nozzles of simultaneous ejections so that power consumption does not exceed a power source capacity, while using a power supply with a limited small-capacity.

For example, if print data for one scan causes a number of simultaneous ejections exceeding a predetermined number of times, printing is performed by two scans dividing one band into an upstream side and a downstream side. Only the upstream side is printed using half of the nozzles of the upstream side in a first scan (forward path). Next, only the downstream side is printed using half of the nozzles of the downstream side by the second scan (rearward path), without performing sheet feeding, and printing for one band is completed. Thus, if the divided print control is executed according to a number of simultaneous ejections, a maximum number of ejecting nozzles can be equal to half a number of all nozzles. As a result, events in which power consumption increases to exceed the power source capacity can be prevented.

However, a number of scans becomes double compared with a case where all nozzles are used in the divided print control, and accordingly a print time increases. In other words, in the divided print control, two scans are performed without performing a sheet feeding operation in one band. Therefore, as bands subjected to the divided print control increase in one page, a time consumed for printing one page increases. Thus, it becomes possible that the current page collides against a leading edge of the next page. Thus, in the present example, increase in the print time which possibly occurs in the divided print control is defined as a print time delay event, which is the requirement for prohibition of the next page feed in step S11 in FIG. 5.

Figure 9:
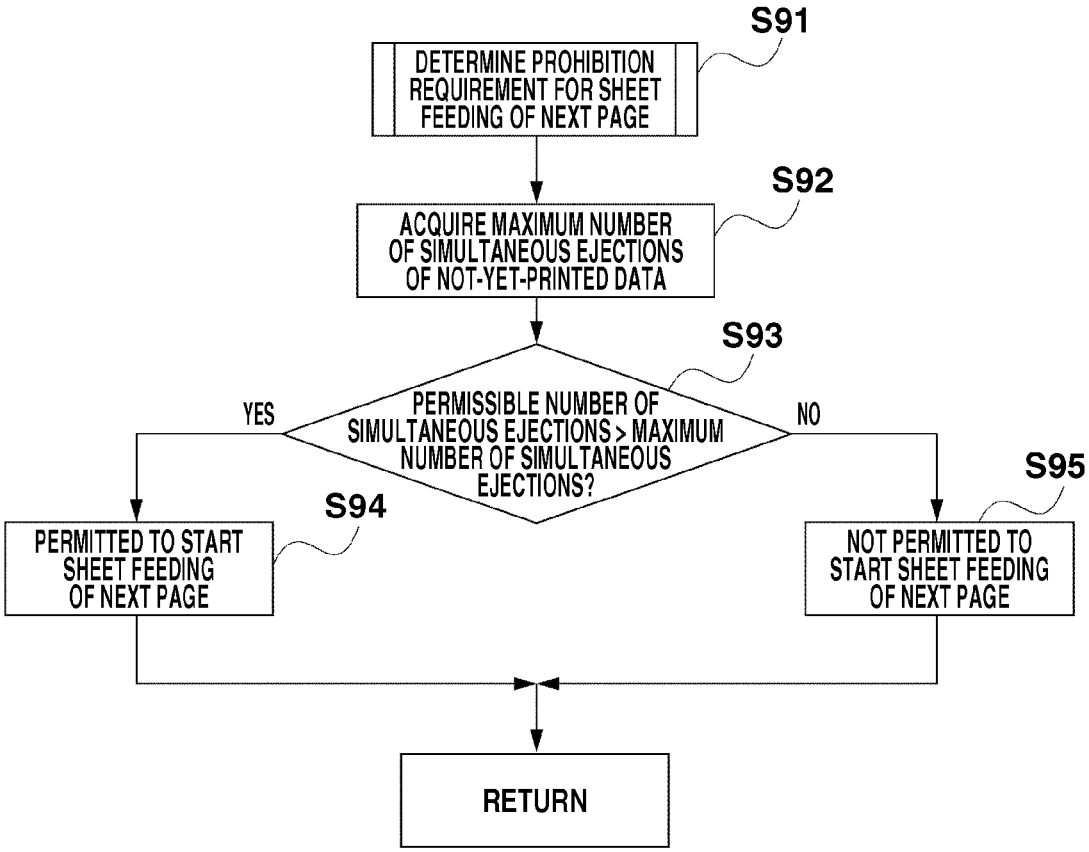
FIG. 9 is a flowchart illustrating a determination sequence of a third exemplary embodiment.

An operation sequence in a case where a limit of a maximum number of simultaneous ejections is the requirement for prohibition of the next page feed will be described below with reference to a flowchart in FIG. 9. In step S91, the control unit starts a determination process about the requirement for prohibition of the next page feed. In step S92, the control unit analyzes not-yet-printed data stored on the memory (RAM 402) of the control unit, and acquires a maximum number of simultaneous ejections in the print data for one band. In step S93, the control unit compares between the maximum number of simultaneous ejections of the above-described acquired not-yet-printed data, and a number of the nozzles capable of performing simultaneous ejecting operation which is specified in advance based on power source capacity (permissible number of simultaneous ejections). If the permissible number of simultaneous ejections is larger than a maximum number of simultaneous ejections as a result of the comparison (YES in step S93), then in step S94, a start of the sheet feeding of the next page is permitted, since the divided print control does not occur. On the other hand, if the permissible number of simultaneous ejections is not larger than the maximum number of simultaneous ejections (NO in step S93), then in step S95, the next page conveyance start is not permitted, since the divided print control occurs and the print time increases.

As described above, the control unit can execute the divided print control for printing by restricting the number of the nozzles to be used at one time if the number of simultaneous ejections from the nozzles acquired by analyzing the not-yet-printed data is larger than the predetermined value. Then the control unit performs control to determine whether the sheet feeding of the next page by the sheet feeding unit while the current page is being printed should be permitted, based on the number of simultaneous ejections from the nozzles acquired by analyzing the not-yet-printed data. Similar effect to that described in the first exemplary embodiment can be obtained in the third exemplary embodiment.

A fourth exemplary embodiment of the present invention will be described below. Since an operation sequence of printing is similar to that illustrated in FIG. 5, description thereof is not repeated. A difference from the foregoing exemplary embodiments lies in the determination in step S11 in FIG. 5.

When printing is carried out, minute liquid droplets (ink mists) that accompany ejected ink droplets and are ejected with a low velocity, are produced and float within the printing apparatus. When the ink mists adhere to the vicinity of the nozzles and are accumulated, they will have an effect on an ejection direction of inks, and cause a deviation of an ink droplet impact position onto a sheet, which will lead to degradation of image quality. Further, the accumulated inks for a plurality of colors may enter into the nozzles and cause color mixture of the inks in some cases. Therefore, a recovery mechanism 300 provided with a cleaning mechanism having a wiper, executes a cleaning (recovery processing) by periodically wiping off the inks which adhere to the nozzle surfaces of the recording head. The control unit counts cumulative number of ejection times, and causes the recovery mechanism 300 to perform cleaning if a predetermined count number is exceeded. Alternatively, after counting a cumulative print time, or a cumulative apparatus activation time, cleaning may be performed when the cumulative time exceeds the predetermined value. In other words, a period for timing of cleaning is determined based on the cumulative number of ejection times or the cumulative usage time.

In an ink-jet recording head including a heater, minute bubbles may be generated secondarily at the time of vanishment of air bubbles which have been generated by ejections. The minute bubbles will be accumulated in proportion to the number of ejection times within the nozzles filled up with the inks. When the accumulated bubbles reach a certain volume, it possibly causes a trouble to ink supply to the nozzles. For this reason, the recovery mechanism 300 is provided with a suction mechanism that forcibly removes in sucking manner air bubbles within the nozzles by gas-tightly capping the recording head and sucking air. The suction (recovery processing) is periodically performed. The control unit counts cumulative number of ejection times and performs cleaning when the cumulative number of ejection times exceeds a predetermined count number. Alternatively, the control unit counts a cumulative print time, or a cumulative apparatus activation time, and may perform suction operation when the cumulative time exceeds the predetermined value. In other words, a period for timing of suction is determined depending on the cumulative number of ejection times or the cumulative usage time.

If a recovery processing such as cleaning processing or suction processing is periodically performed in this way, a print interruption time (waiting time) for the recovery processing during printing operation of the current page or between the current page and the next page is taken. If the sheet of the next page is fed and a print interruption occurs during the coating operation, then a conveyance of the sheet is interrupted, and accordingly the coating operation is also interrupted and uneven coating might be generated on the sheet. If only the coating operation is executed during the print interruption, the sheets of the current page and the next page possible may collide against each other. Thus, in the present example, an occurrence of the waiting time consumed by the recovery processing is defined as a temporary print interruption event, which is the requirement for prohibition of the next page feed in step S11 in FIG. 5.

Figure 10:
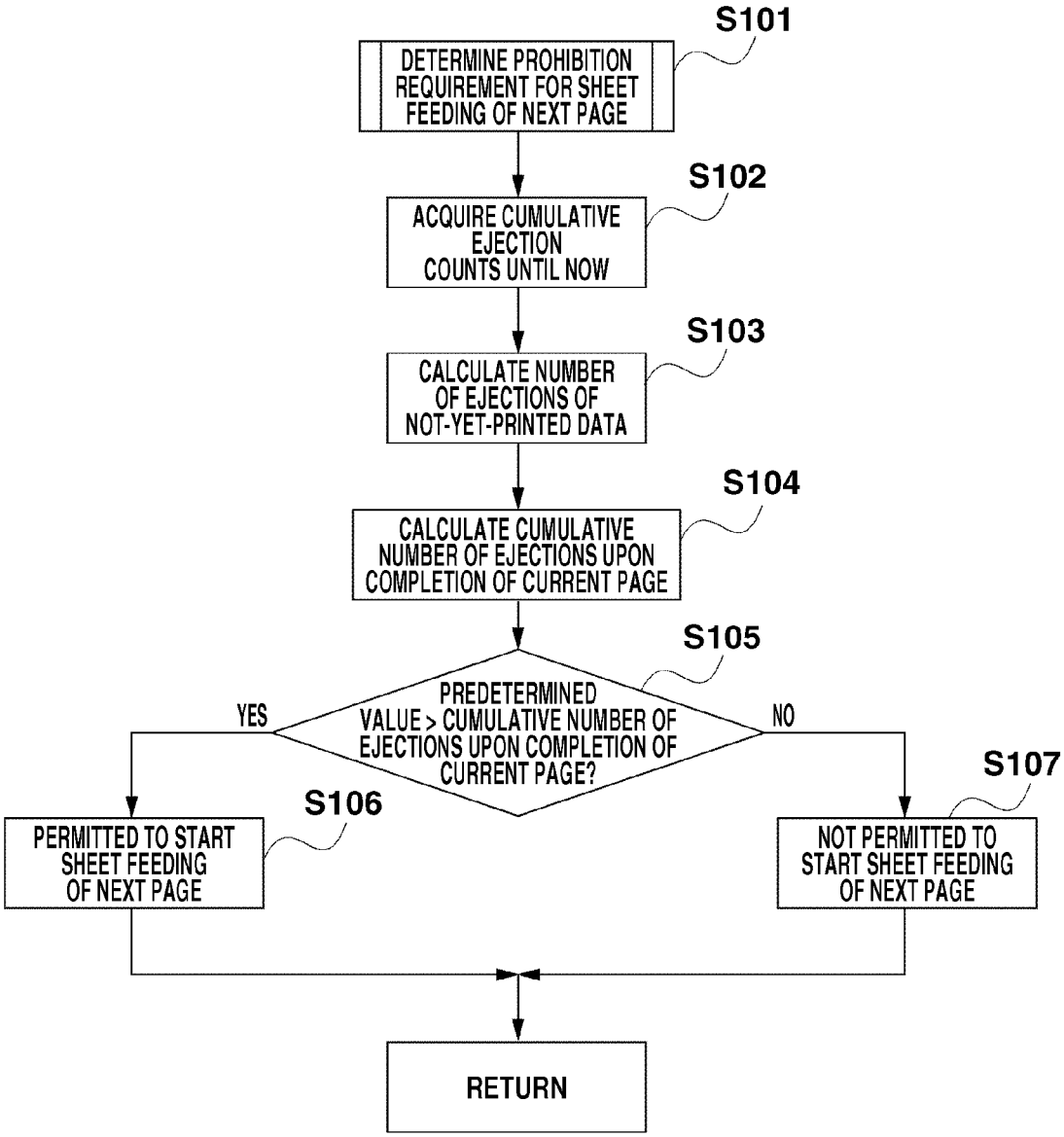
FIG. 10 is a flowchart illustrating a determination sequence of a fourth exemplary embodiment.

An operation sequence in a case where the waiting time consumed by the recovery processing is defined as the requirement for prohibition of the next page feed will be described below with reference with a flowchart in FIG. 10. In step S101, the control unit starts a determination process about the requirement for prohibition of the next page feed. In step S102, the control unit acquires the cumulative number of ejection times (count values) until now. In step S103, the control unit calculates a number of ejection times for printing operation of the not-yet-printed data stored on the memory (RAM 402). In step S104, the control unit calculates anticipated cumulative number of ejection times at the time of completion of the current page by adding a cumulative number of ejection times at a current time point to a number of ejection times of the not-yet-printed data. In step S105, the control unit compares between a cumulative number of ejection times anticipated at the time of completion of the calculated current page and a predetermined value specified according to the recovery processing. The recovery processing includes a cleaning operation and a suction operation, but periods suitable for respective operations are different from each other, and predetermined values vary depending on respective periods. As a result of the comparison, if a predetermined value corresponding to either of the recovery processing is not reached (YES in step S105), a print interruption by the recovery processing does not occur. As a result, in step S106, a start of the next page feeding is permitted. If the cumulative number exceeds a predetermined value of at least one of the recovery processing (NO in step S105), the print interruption caused by the recovery processing occurs. As a result, in step S107, a start of the next page feeding is not permitted.

As described above, timing for executing the recovery processing may be determined, based on a cumulative usage time (print time or apparatus activation time) in place of the cumulative number of ejection times. In this case, it is determined whether the cumulative usage time reaches the predetermined value (which is different in a case of cleaning processing and in a case of suction processing) corresponding to a period of the recovery processing during execution of printing operation. If either of the cumulative usage time does not reach the predetermined value, a start of the sheet feeding to print the next page is permitted. If at least one of the cumulative usage time reaches the predetermined value, a start of the next page feeding is not permitted.

The recovery mechanism includes, in addition to the cleaning mechanism and the suction mechanism, a reception unit for receiving ink discharged by the preliminary ejection, and a mechanism for discharging accumulated ink in the reception unit. An ink volume which can be accumulated in the reception unit is limited, and discharging the inks in the reception unit before the volume exceeds the capacity of the reception unit is to be performed. At the time of an ink discharge from the reception unit, a print interruption time (waiting time) is taken and the above-described situation possibly arises. Thus, the control unit counts the cumulative number of ejection times of the preliminary ejection, and performs control to determine whether the sheet feeding of the next page by the sheet feeding unit should be permitted, depending on whether the count value has reached the predetermined value corresponding to the capacity of the reception unit. If a count value of the preliminary ejection does not reach the predetermined value, a start of the next page feeding to print the next page is permitted. If the count value of the preliminary ejection has reached the predetermined value, a start of the next page feeding is not permitted.

In this way, the control unit performs control to determine whether the sheet feeding of the next page by the sheet feeding unit while the current page is being printed should be permitted, based on whether the recovery processing in the recovery mechanism has been executed. More specifically, the control unit performs control to determine whether the sheet feeding of the next page by the sheet feeding unit while the current page is being printed should be permitted, depending on whether the cumulative number of ejection times or the cumulative usage time has reached the predetermined value corresponding to periods of the cleaning operations. Similar effect to that described in the first exemplary embodiment can be obtained as well in the fourth exemplary embodiment.

A fifth exemplary embodiment, further in addition to the functions of the foregoing exemplary embodiments, has a drying mode for performing temporary interruption of printing of the next page to fix and dry ink after printing by the printing unit. This is to prevent bleeding of ink on the sheet, and transfer of ink onto the next page. If the amount of ejected ink is larger than a predetermined value, based on an amount of ejected ink in the printing of the current page, that is, if moistening of the sheet is large, the control unit executes the drying mode. Alternatively, the drying mode may be executed according to a user's instruction input to the operation unit. In other words, according to the present example, execution of the drying mode is defined as a temporary print interruption event, which occurs for prohibition of the next page feed in step S11 in FIG. 5. The control unit determines whether the drying mode has been executed, based on the amount of ejected ink in the printing of the current page, or presence or absence of the user's input instruction to the operation unit, and performs control to determine whether the sheet feeding of the next page by the sheet feeding unit while the current page is being printed should be permitted based on the determination. Thereby, similar effect to that in the foregoing exemplary embodiments can be obtained.

Hereinbefore, several examples for prohibition of the next page feed have been described, but the present invention may be implemented in combination of any or all of these.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-118977 filed May 15, 2009 and Application No. 2010-082797 filed Mar. 31, 2010, which are hereby incorporated by reference herein in their entirety.

What is claimed is:

1. An apparatus comprising:

a feeding unit configured to feed sheets one by one from a storing unit;

a coating unit configured to apply a coating liquid on the fed sheet;

a printing unit having a recording head configured to carry out printing operation on the coated sheet;

a recovery unit having a cleaning mechanism configured to perform cleaning of nozzle surfaces of the recording head; and a control unit configured to control operations of the sheet feeding unit, the coating unit, the printing unit and the recovery unit, wherein the control unit performs control to determine timing to start feeding of a next page when the current page is being printed, based on execution timing of the recovery, and wherein the control unit performs control to determine whether sheet feeding of a next page while the current page is being printed should be permitted, depending on whether a number of cumulative ejection times or a cumulative usage time has reached a predetermined value corresponding to a period of the cleaning.

2. An apparatus comprising:

a feeding unit configured to feed sheets one by one from a storing unit;

a coating unit configured to apply a coating liquid on the fed sheet;

a printing unit having a recording head configured to carry out printing operation on the coated sheet;

a recovery unit having a suction mechanism configured to perform suction of nozzles of the recording head; and a control unit configured to control operations of the sheet feeding unit, the coating unit, the printing unit and the recovery unit, wherein the control unit determines whether sheet feeding of a next page while a current page is being printed should be permitted, depending on whether the number of cumulative ejection times or the cumulative usage time has reached a predetermined value corresponding to a period of the suction.

3. An apparatus comprising:

a feeding unit configured to feed sheets one by one from a storing unit;

a coating unit configured to apply a coating liquid on the fed sheet;

a printing unit having a recording head configured to carry out printing operation on the coated sheet;

a recovery unit having a reception unit configured to receive ink discharged by a preliminary ejection and a mechanism for discharging an ink accumulated in the reception unit; and a control unit configured to control operations of the sheet feeding unit, the coating unit, the printing unit and the recovery unit, wherein the control unit determines whether sheet feeding of a next page while a current page is being printed should be permitted, depending on whether a number of cumulative ejection times of the preliminary ejection has reached a predetermined value corresponding to a capacity of the reception unit.

* * * * *